US010026571B1

(12) United States Patent
Hermosillo et al.

(10) Patent No.: US 10,026,571 B1
(45) Date of Patent: Jul. 17, 2018

(54) SWITCHING CHAMBER FOR A GAS-INSULATED CIRCUIT BREAKER COMPRISING AN OPTIMIZED THERMAL CHANNEL

(71) Applicant: General Electric Technology GmbH, Baden (CH)

(72) Inventors: Victor F. Hermosillo, Bethel Park, PA (US); Othman Zakaria, Villeurbanne (FR); Quentin Rognard, Lyons (FR)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 0 days.

(21) Appl. No.: 15/475,424

(22) Filed: Mar. 31, 2017

(51) Int. Cl.

| | |
|---|---|
| ***H01H 33/74*** | (2006.01) |
| ***H01H 33/70*** | (2006.01) |
| ***H01H 33/56*** | (2006.01) |
| ***H01H 33/95*** | (2006.01) |

(52) U.S. Cl.
CPC ..... *H01H 33/7046* (2013.01); *H01H 33/56* (2013.01); *H01H 33/74* (2013.01); *H01H 33/95* (2013.01)

(58) Field of Classification Search
CPC ..... H01H 33/91; H01H 33/7023; H01H 2033/888; H01H 2033/028; H01H 2033/908; H01H 33/904; H01H 33/905; H01H 2033/906; H01H 33/22; H01H 33/42; H01H 33/901; H01H 2033/566; H01H 33/88; H01H 33/7061
See application file for complete search history.

(56) References Cited

U.S. PATENT DOCUMENTS

| | | | | | |
|---|---|---|---|---|---|
| 4,236,053 | A | * | 11/1980 | Sasaki | H01H 33/24 218/57 |
| 4,467,158 | A | * | 8/1984 | Kobayashi | H01H 1/385 218/57 |
| 4,774,388 | A | * | 9/1988 | Thuries | H01H 33/903 218/59 |
| 4,983,791 | A | * | 1/1991 | Thuries | H01H 33/903 218/59 |
| 5,001,314 | A | * | 3/1991 | Thuries | H01H 33/903 218/59 |
| 5,105,058 | A | * | 4/1992 | Perret | H01H 33/16 218/65 |
| 5,160,818 | A | * | 11/1992 | Dufournet | H01H 33/903 218/66 |

(Continued)

*Primary Examiner* — Truc Nguyen
(74) *Attorney, Agent, or Firm* — GE Global Patent Operation; Scott R. Stanley

(57) ABSTRACT

To improve an interruption process, a switching chamber for a gas-insulated circuit breaker comprises a thermal channel having a bend part delimited by an outer surface of an auxiliary insulating nozzle including a first bend section on a thermal volume side, a third bend section on an arcing region side, and a second bend section connecting the first bend section to the third bend section, and by an inner surface of a main insulating nozzle including a fourth bend section on a thermal volume side, a sixth bend section on an arcing region side, and a fifth bend section connecting the fourth bend section to the sixth bend section, such that in axial section view, the first to sixth bend sections form 30 degrees arcs of circles having respective radii R1, R2, R3, R4, R5 and R6 such that R1>R2>R3 and R4>R5>R6.

11 Claims, 3 Drawing Sheets

(56) References Cited

U.S. PATENT DOCUMENTS

| | | | | |
|---|---|---|---|---|
| 6,472,629 | B2 * | 10/2002 | Dufournet | H01H 33/98 218/43 |
| 8,816,237 | B2 * | 8/2014 | Dufournet | H01H 33/905 218/46 |
| 9,058,947 | B2 * | 6/2015 | Yaginuma | H01H 33/08 |
| 2008/0006608 | A1 * | 1/2008 | Saxl | H01H 33/7015 218/156 |

* cited by examiner

SWITCHING CHAMBER FOR A GAS-INSULATED CIRCUIT BREAKER COMPRISING AN OPTIMIZED THERMAL CHANNEL

TECHNICAL FIELD

The present invention relates to a switching chamber, sometimes also called a switching chamber, for a gas-insulated circuit breaker, such as a high-voltage circuit breaker, of the type comprising a thermal channel connecting an arcing region to a thermal volume provided for storing quenching gas to be injected into the arcing region.

More precisely, the invention concerns a switching chamber comprising two arcing contacts movable relative to one another along an axis, a main insulating nozzle and an auxiliary insulating nozzle both extending around the axis such as to delimit an arcing region, a thermal volume for storing insulating gas, and a thermal channel extending between an outer surface of the auxiliary insulating nozzle and an inner surface of the main insulating nozzle so that the thermal channel connects the thermal volume to the arcing region, wherein the thermal channel comprises a first part opening in the thermal volume, a second part opening in the arcing region, and a bend part connecting the first part to the second part so as to achieve a 90 degrees turn.

The invention also relates to a gas-insulated circuit breaker comprising such a switching chamber.

BACKGROUND ART

In a single pressure switching chamber of the thermally-assisted puffer or self-blast types, the so-called thermal channel is a channel putting an arcing region into fluidic communication with a thermal volume or chamber.

During the initial stage of current interruption, as main contacts of the switching chamber separate and an electric arc is established between the male and female arcing contacts, the thermal channel provides a conduit for feeding hot gases from the arcing region, which is the volume between the male and female arcing contacts, into the thermal volume. The arc heats the insulating gas, such as SF6, between the contacts, and the heated gas is fed into the thermal volume in order to increase the pressure in this volume. This first phase is sometimes called the thermal volume pressurization phase. In a subsequent phase, the direction of gas flow in the thermal channel reverts and the previously stored insulating gas flows from the thermal volume into the arcing region through this channel. This action promotes the flow of insulating gas that transports heat away from the arcing region and provides adequate gas density and temperature across the arcing contacts to obtain successful interruption of an AC current after it decays to zero and in order for the gap to withstand the transient recovery voltage appearing across the switching chamber.

As is widely known, in a switching chamber of the thermally-assisted puffer type, a single volume or chamber plays the role of a compression volume, since gas inside this volume is pressurized by a moving piston or puffer, and the role of a thermal volume, since gas pressurization is increased by the arc thermal energy. In a switching chamber of the self-blast type, there are two distinct volumes or chambers, namely the thermal volume which is of fixed volume and which opens into the thermal channel, and the compression volume which is of variable volume and which is connected to the thermal volume through a valve.

In the present disclosure, the "thermal volume" can indifferently be the single volume of a thermally-assisted puffer type switching chamber or the so-called thermal volume of a self-blast type switching chamber.

The thermal channel is formed by the outer surface of the auxiliary nozzle and the inner surface of the main nozzle in the region between the thermal volume and the arcing region.

The shapes currently used for the thermal channel to achieve the 90 degrees turn from the longitudinal to the radial direction with respect to the switching chamber axis are simple arc segments with constant radius throughout the turn.

The applicant realized that such shapes are not optimal. In particular, the applicant found that these shapes lead to the formation of turbulence and eddies in the thermal channel which obstruct the insulating gas flow and reduce the efficiency of the pressurization phase of the thermal channel and of the subsequent injection of gas into the arcing region.

A purpose of the invention is to improve the thermal channel shape and in particular to reduce or even avoid the formation of turbulence and eddies in the thermal channel.

SUMMARY OF THE INVENTION

To this end, an object of the present invention is a switching chamber of the aforementioned type, wherein the bend part is delimited by a portion of the outer surface of the auxiliary insulating nozzle including a first bend section on a thermal volume side, a third bend section on an arcing region side, and a second bend section connecting the first bend section to the third bend section, wherein the bend part is delimited by a portion of the inner surface of the main insulating nozzle including a fourth bend section on a thermal volume side, a sixth bend section on an arcing region side, and a fifth bend section connecting the fourth bend section to the sixth bend section, wherein in axial section view, the first to sixth bend sections form 30 degrees arcs of circles having respective radii R1, R2, R3, R4, R5 and R6, and wherein R1>R2>R3 and R4>R5>R6.

Indeed, after intensive research, the applicant found that such shape for the thermal channel help obtaining laminar flow of the insulating gas that is first injected into the thermal volume to increase pressure and mix the gas in this volume and subsequently injected back radially into the arcing region to quench the arc.

The invention thus permits to increase the speed of insulating gas injection. In addition, it makes it possible to reduce or even prevent the generation of turbulence and eddies inside the thermal channel that may obstruct the flow between the thermal volume and the arcing region. The efficiency of the interruption process is thus globally improved.

According to other advantageous aspects of the invention, the switching chamber includes one or more of the following characteristics, taken alone or in any possible combination:

the respective radii of the first to third bend sections are such that R1=3×R3 and R2=1.8×R3;

the respective radii of the fourth to sixth bend sections are such that R4=3×R6 and R5=1.8×R6;

the respective radii of the first to sixth bend sections are such that R1=3×R3 and R2=1.8×R3 and R4=3×R6 and R5=1.8×R6;

the respective radii R1 and R4 of the first and fourth bend sections are between 5 mm and 80 mm;

the first part of the thermal channel extends parallel to the axis from the thermal volume up to the bend part of the thermal channel;

the second part of the thermal channel extends orthogonal to the axis from the arcing region up to the bend part of the thermal channel;

the first part of the thermal channel is substantially of constant section from the thermal volume up to the bend part of the thermal channel;

the second part of the thermal channel is substantially of constant section from the arcing region up to the bend part of the thermal channel;

a radial distance between the outer surface of the auxiliary insulating nozzle and the inner surface of the main insulating nozzle, in the first part of the thermal channel, is equal to 1.35 times the radius R3 of the third bend section;

an axial distance between the outer surface of the auxiliary insulating nozzle and the inner surface of the main insulating nozzle, in the second part of the thermal channel, is equal to 2.5 times the radius R3 of the third bend section.

The invention also relates to a gas-insulated circuit breaker comprising a switching chamber of the type described above.

BRIEF DESCRIPTION OF THE DRAWINGS

The invention will be better understood and other details, advantages and characteristics of it will become clear after reading the following description given as a non-limitative example with reference to the appended drawings in which.

In all these figures, identical references may denote identical or similar elements.

DETAILED DESCRIPTION

Figure 1:
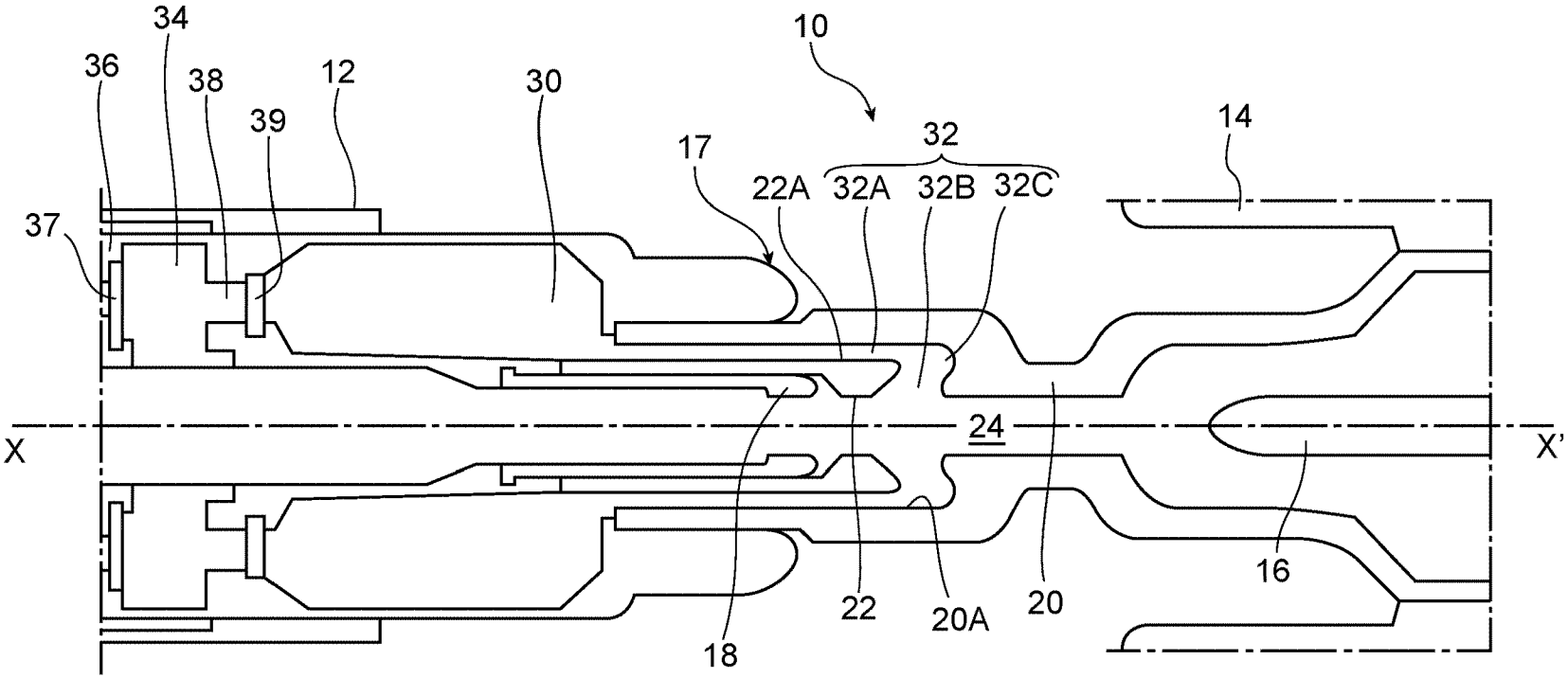
FIG. 1 PRIOR ART
FIG. 1 is a schematic fragmentary axial cross-sectional view of a known thermally-assisted self-blast type switching chamber of a circuit breaker, shown in an open position.

A switching chamber 10 of a known type is shown in FIG. 1. It is a switching chamber of the "self-blast" type which is part of a gas-insulated circuit breaker.

The switching chamber extends along a longitudinal axis XX' which globally constitutes an axis of revolution of the chamber. In the present disclosure, the axial and radial directions are defined with reference to the longitudinal axis XX' (the radial direction being orthogonal to the axis XX' and the axial direction being parallel to said axis).

The switching chamber 10 comprises a pair of permanent or main contacts 12, 14 which are movable relative to one another along the axis XX'. In the illustrated example, contact 14 is stationary whereas contact 12 is movable along the longitudinal axis XX', under the action of an operating member (not shown).

The switching chamber 10 also includes a pair of arcing contact 16, 18 which are also movable relative to one another along the axis XX'. In the illustrated example, arcing contact 16 is mechanically connected to the permanent contact 14 and is thus stationary, whereas arcing contact 16 is connected to a movable assembly 17 comprising the movable permanent contact 12.

The switching chamber 10 is enclosed in a casing (not shown) containing an insulating gas, e.g. SF6.

Generally speaking, when electric current flowing through the permanent contacts 12 and 14 is to be interrupted, the switching chamber is operated such as to separate the permanent contacts from each other. The arcing contacts 16 and 18 separate shortly after that, which gives rise to an electric arc between these arcing contacts. Such arc then has to be quenched.

To that end, the switching chamber 10 conventionally includes a main insulating nozzle 20 and an auxiliary insulating nozzle 22 which are secured to the arcing contact 18 and which contribute to delimiting an arcing region 24 where the electric arc forms when the arcing contacts 16 and 18 separate.

A first chamber or volume referred to as the thermal volume 30 is defined inside the movable assembly 17. This thermal volume 30 defines a fixed volume that is brought in translation with the movable assembly 17 when the contacts separate. The thermal volume 30 opens out into a channel referred to as the thermal channel 32 which puts the thermal volume 30 into fluidic communication with the arcing region 24. Such thermal channel 32 is delimited by an outer surface 22A of the auxiliary insulating nozzle 22 and an inner surface 20A of the main insulating nozzle 20. In particular, the thermal channel 32 comprises a first part 32A opening in the thermal volume 30, a second part 32B opening in the arcing region 24, and a bend part 32C connecting the first part 32A to the second part 32B so as to achieve a 90 degrees turn.

A second chamber or volume referred to as the compression volume 34 is arranged behind the thermal volume 30 and is notably delimited by a fixed back wall 36 which forms a piston or puffer which makes the volume of the compression volume 34 vary when the contacts separate. This back wall 36 is conventionally fitted with an over-pressure valve 37. The compression volume 34 communicates with the thermal volume 30 through a passageway 38 which gets closed by a valve 39 as soon as gas pressure inside the thermal volume 30 reaches a predefined level.

When a nominal electric current is to be interrupted, the thermal energy of the arc is not sufficient to raise the gas pressure inside the thermal volume 30 at the above-mentioned predefined level, such that the valve 39 remains open. Compression of the insulating gas that will quench the arc mainly takes place in the compression volume 34 and is further increased in the thermal volume 30 by thermal energy from the arc.

Now, when a higher current has to be interrupted, such as a short-circuit current, the thermal energy of the arc raises the gas pressure inside the thermal volume 30 above the predefined level, such that the valve 38 closes. Compression of the insulating gas that will quench the arc thus entirely takes place in the thermal volume 30 thanks to thermal energy from the arc.

The particular features of the invention will now be described with reference to FIGS. 2 and 2A that show a switching chamber 100 of the same type as the switching chamber 10 of FIG. 1, but wherein the thermal channel 32 has an optimized shape which makes it possible to increase the speed of insulating gas through the thermal channel and to reduce or even prevent the generation of turbulence and eddies inside the thermal channel.

Figure 2:
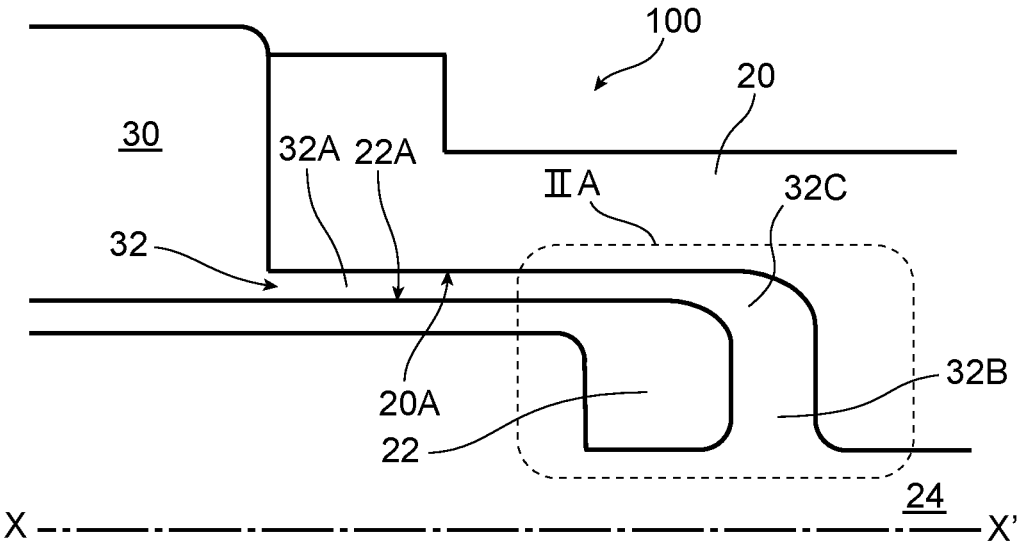
FIG. 2 is a schematic fragmentary axial half-cross-sectional view of a switching chamber of a circuit breaker according to a preferred embodiment of the invention.
Figure 2A:
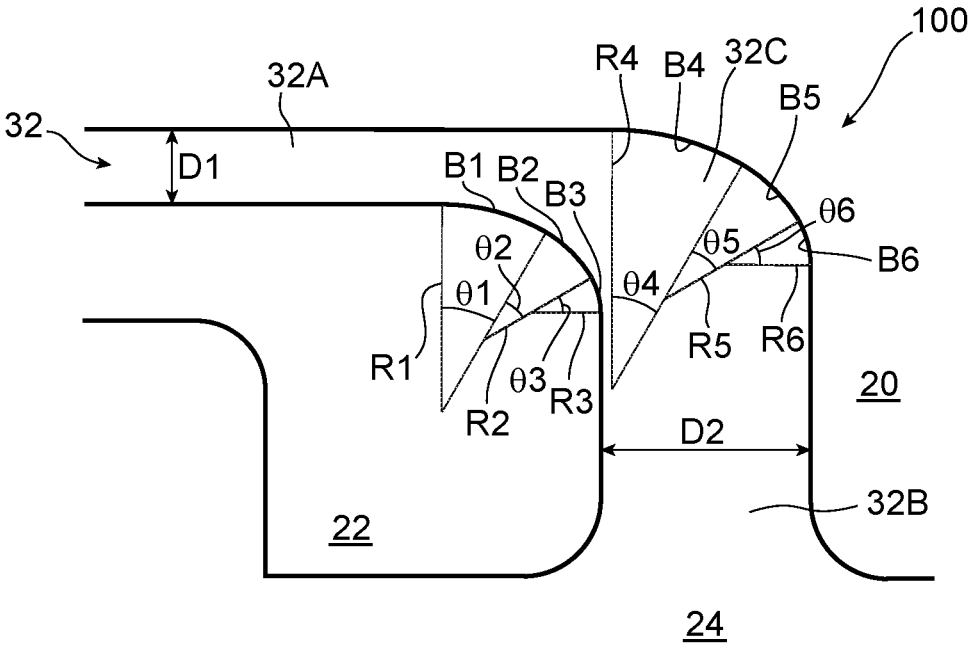
FIG. 2A is an enlarged view of part IIA of FIG. 2.

As shown more clearly in FIG. 2A, the bend part 32C of the thermal channel 32 is delimited by a portion of the outer surface 22A of the auxiliary insulating nozzle 22 including a first bend section B1 on the thermal volume side, a third bend section B3 on the arcing region side, and a second bend section B2 connecting the first bend section B1 to the third bend section B3. In other words, the first section B1 connects the second bend section B2 to a portion of the outer surface 22A delimiting the first part 32A of the thermal channel, whereas the third bend section B3 connects the second bend section B2 to a portion of the outer surface 22A delimiting the second part 32B of the thermal channel.

Similarly, the bend part 32C is delimited by a portion of the inner surface 20A of the main insulating nozzle 20 including a fourth bend section B4 on the thermal volume side, a sixth bend section B6 on the arcing region side, and a fifth bend section B5 connecting the fourth bend section B4 to the sixth bend section B6. In other words, the fourth bend section B4 connects the fifth bend section B5 to a portion of the inner surface 20A delimiting the first part 32A of the thermal channel, whereas the sixth bend section B6 connects the fifth bend section B5 to a portion of the inner surface 20A delimiting the second part 32B of the thermal channel.

Moreover, in axial section view as in FIGS. 2 and 2A, the first to sixth bend sections B1-B6 respectively form 30 degrees arcs of circles (see FIG. 2A: the respective angles θ1-θ6 of the first to sixth bend sections each equal 30 degrees).

In addition, the respective radii R1, R2, R3, R4, R5 and R6 of the first to sixth bend sections B1-B6 are such that R1>R2>R3 and R4>R5>R6. In other words, the respective radii are decreasing from the first bend section B1 to the third bend section B3 on the one hand, and from the fourth bend section B4 to the sixth bend section B6 on the other hand.

In the preferred embodiment, the respective radii R1, R2, R3, R4, R5 and R6 of the first to sixth bend sections B1-B6 are such that:

R1=3×R3;

R2=1.8×R3;

R4=3×R6 and

R5=1.8×R6.

Moreover, the respective radii R1 and R4 of the first and fourth bend sections B1 and B4 are preferably between 5 mm and 80 mm.

In the illustrated embodiment, the first part 32A of the thermal channel extends parallel to the axis XX' and is substantially of constant section, from the thermal volume 30 up to the bend part 32C of the thermal channel, whereas the second part 32B of the thermal channel extends orthogonal to the axis XX' and is also substantially of constant section, from the arcing region 24 up to the bend part 32C of the thermal channel.

In the illustrated example, the radial distance D1 (FIG. 2A) between the outer surface 22A of the auxiliary insulating nozzle 22 and the inner surface 20A of the main insulating nozzle 20, in the first part 32A of the thermal channel, is equal to 1.35 times the radius R3 of the third bend section B3. In addition, the axial distance D2 between the outer surface 22A of the auxiliary insulating nozzle 22 and the inner surface 20A of the main insulating nozzle 20, in the second part 32B of the thermal channel, is equal to 2.5 times the radius R3 of the third bend section B3.

Figure 3:
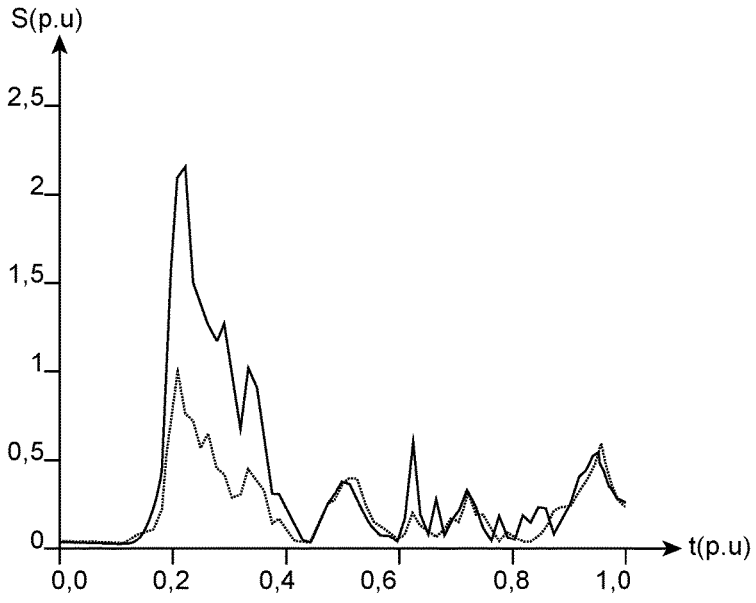
FIG. 3 is a graph illustrating the flow speed S as a function of time t in a thermal channel of the switching chamber of FIG. 1 (solid line), respectively of the switching chamber of FIG. 2 (dotted line).

FIG. 3 shows the improvements as regards flow speed S of insulating gas in the optimized thermal channel 32 of FIGS. 2 and 2A (in solid line) as compared to the flow speed of insulating gas in the non-optimized thermal channel 32 of FIG. 1 (in dotted line).

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A switching chamber for a gas-insulated circuit breaker, comprising:

two arcing contacts movable relative to one another along an axis, a main insulating nozzle and an auxiliary insulating nozzle both extending around the axis such as to delimit an arcing region, a thermal volume for storing insulating gas, a thermal channel extending between an outer surface of the auxiliary insulating nozzle and an inner surface of the main insulating nozzle so that the thermal channel connects the thermal volume to the arcing region, wherein the thermal channel comprises a first part opening in the thermal volume, a second part opening in the arcing region, and a bend part connecting the first part to the second part so as to achieve a 90 degrees turn, wherein the bend part is delimited by a portion of the outer surface of the auxiliary insulating nozzle including a first bend section on a thermal volume side, a third bend section on an arcing region side, and a second bend section connecting the first bend section to the third bend section, wherein the bend part is delimited by a portion of the inner surface of the main insulating nozzle including a fourth bend section on a thermal volume side, a sixth bend section on an arcing region side, and a fifth bend section connecting the fourth bend section to the sixth bend section, wherein in axial section view, the first to sixth bend sections form 30 degrees arcs of circles having respective radii R1, R2, R3, R4, R5 and R6, wherein R1>R2>R3 and R4>R5>R6; and wherein the respective radii of the first to third bend sections are such that R1=3×R3 and R2=1.8×R3.

2. The switching chamber according to claim 1, wherein the respective radii of the fourth to sixth bend sections are such that R4=3×R6 and R5=1.8×R6.

3. The switching chamber according to claim 1, wherein the respective radii of the first to sixth bend sections are such that R1=3×R3 and R2=1.8×R3 and R4=3×R6 and R5=1.8×R6.

4. The switching chamber according to claim 1, wherein the respective radii R1 and R4 of the first and fourth bend sections are between 5 mm and 80 mm.

5. The switching chamber according to claim 1, wherein the first part of the thermal channel extends parallel to the axis from the thermal volume up to the bend part of the thermal channel.

6. The switching chamber according to claim 1, wherein the second part of the thermal channel extends orthogonal to the axis from the arcing region up to the bend part of the thermal channel.

7. The switching chamber according to claim 1, wherein the first part of the thermal channel is substantially of constant section from the thermal volume up to the bend part of the thermal channel.

8. The switching chamber according to claim 1, wherein the second part of the thermal channel is substantially of constant section from the arcing region up to the bend part of the thermal channel.

9. The switching chamber according to claim 1, wherein a radial distance between the outer surface of the auxiliary insulating nozzle and the inner surface of the main insulating nozzle, in the first part of the thermal channel, is equal to 1.35 times the radius R3 of the third bend section.

10. The switching chamber according to claim 1, wherein an axial distance between the outer surface of the auxiliary insulating nozzle and the inner surface of the main insulating nozzle, in the second part of the thermal channel, is equal to 2.5 times the radius R3 of the third bend section.

11. A gas-insulated circuit breaker comprising a switching chamber according to claim 1.

* * * * *